US006531816B1

(12) United States Patent
Breskin et al.

(10) Patent No.: US 6,531,816 B1
(45) Date of Patent: Mar. 11, 2003

(54) PROTECTION OF PHOTOCATHODES WITH THIN FILM OF CESIUM BROMIDE

(75) Inventors: Amos Breskin, Nes Ziona (IL); Rachel Chechik, Beit Hanan (IL); Alexei Buzulutskov, Novosibirsk (RU)

(73) Assignee: Yeda Research & Development Co. Ltd., Rehovor (IL)

( * ) Notice: Subject to any disclaimer, the term of this patent is extended or adjusted under 35 U.S.C. 154(b) by 0 days.

(21) Appl. No.: 09/423,278

(22) PCT Filed: Apr. 28, 1998

(86) PCT No.: PCT/IL98/00202

§ 371 (c)(1),
(2), (4) Date: Jan. 27, 2000

(87) PCT Pub. No.: WO98/50934

PCT Pub. Date: Nov. 12, 1998

(30) Foreign Application Priority Data

May 4, 1997 (IL) ..... 120774

(51) Int. Cl.[7] ..... H01J 40/06
(52) U.S. Cl. ..... 313/542; 313/541; 313/544
(58) Field of Search ..... 313/541, 542, 313/544, 373, 375

(56) References Cited

U.S. PATENT DOCUMENTS

| | | | | |
|---|---|---|---|---|
| 2,264,717 A | | 12/1941 | Ruedy | 250/165 |
| 3,693,018 A | * | 9/1972 | Spicer | 250/213 |
| 3,712,700 A | | 1/1973 | Sommer | 316/19 |
| 4,419,603 A | | 12/1983 | Nussli et al. | 313/345 R |
| 4,639,638 A | | 1/1987 | Purcell et al. | 313/534 |
| 4,853,595 A | * | 8/1989 | Alfano et al. | 313/532 |
| 4,931,704 A | * | 6/1990 | Alfano et al. | 315/384 |
| 4,950,952 A | * | 8/1990 | Aramaki | 313/542 |
| 5,223,717 A | * | 6/1993 | Charpak | 250/374 |
| 5,256,870 A | * | 10/1993 | Raverdy et al. | 250/214 UT |
| 5,285,061 A | * | 2/1994 | She et al. | 250/214 VT |

FOREIGN PATENT DOCUMENTS

| | | |
|---|---|---|
| DE | 15 39 973 | 3/1970 |
| EP | 0 190 079 | 8/1986 |
| EP | 0 627 755 | 12/1994 |
| GB | 2 081 006 | 2/1982 |

OTHER PUBLICATIONS

Buzulutskov, A. et al, "Protection of Cesium–Antimony Photocathodes", presented at the 1st Conference on New Developments in Photodetection, Beaune, France, Jun. 1996.

Enomoto, et al., "Test of Various Photocathodes," Nucl. Instr. & Meth. A343 (1994), pp. 117–120.

Peskov, et al., "Gaseous detectors of ultraviolet and visible photons," Nucl. Instr. & Meth. A353 (1994) 184–188.

Breskin, et al., "New Ideas in CsI–Based Photon Detectors: Wire Photomultipliers and Protection of the Photocathodes," IEEE Trans. Nucl. Sci. 43 (1995) 298–305. Presentation to be Pub.

Buzulutskov, et al., "Study of Photocathode protection with thin dielectric films," Nucl. Instr. & Meth. A371 (1996) 147–150.

Breskin, et al., "Evidence for thin–film protection of visible photocathodes," Appl. Phys. Lett. 69 (1996) 1008–1010.

Buzulutskov, et al., "Photoemission through thin dielectric coating films," J. Appl. Phys. 81 (1997) 466–479.

(List continued on next page.)

*Primary Examiner*—Ashok Patel
*Assistant Examiner*—Glenn D. Zimmerman
(74) *Attorney, Agent, or Firm*—Christie, Parker & Hale, LLP

(57) ABSTRACT

This invention discloses a thin-film-coated photocathode, including a photocathode formed of first material consisting of potassium cesiuin antimonide and a thin-film coating of a second material consisting of cesium bromide (CsBr).

14 Claims, 5 Drawing Sheets

OTHER PUBLICATIONS

Breskin, et al., "Removable organic protective coating for alkali–antimonide photocathodes," Nucl. Instr. & meth. A 413 (1998) 275–280.
Buzulutskov, et al., "Protection of cesium–antimony photocathodes," Nucl. Instr. & Meth. A 387 (1997) 176–179.
Buzulutskov, et al., "The protection of K–Cs–Sb photocathodes with CsBr films," Nucl. Instr. & Meth. A400 (1997) 173–176.
Shefer, et al., "Laboratory production of efficient alkali–antimonide photocathodes," Nucl. Instr. & Meth. A411 (1998) 383–388.
R. Enomoto et al., Nucl. Instrum. and Meth. A343, 117 (1994) (on order).
V. Peskov et al., Nucl. Instrum. and Meth. A353, 184 (1994) (on order).
A. Breskin et al., IEEE Trans. Nucl. Sci 43,298 (1995) (on order).
A. Buzulutskov et al., Nuclear Instruments and Methods in Physics Research A371 (1996) pp. 147–150 (on order).
A. Breskin et al., Appl. Phys. Lett. 69, 1008 (1996) (on order).
A. Buzulutskov et al., Appl. Phys. 81, 466 (1997) (on order).

* cited by examiner

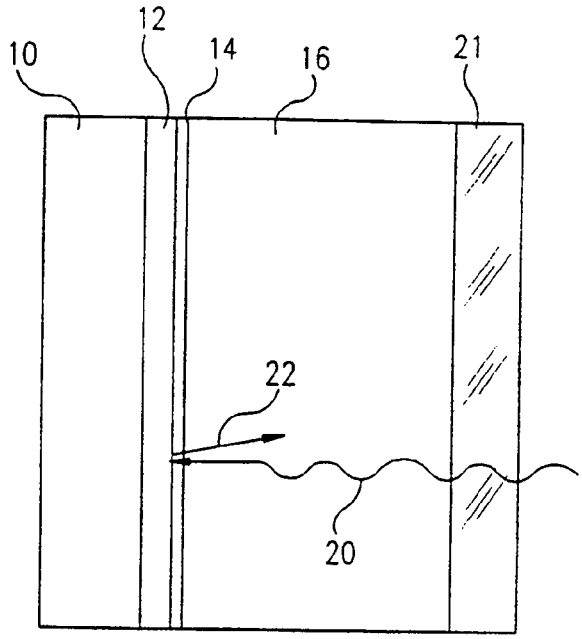
FIG. 5
FIG. 6
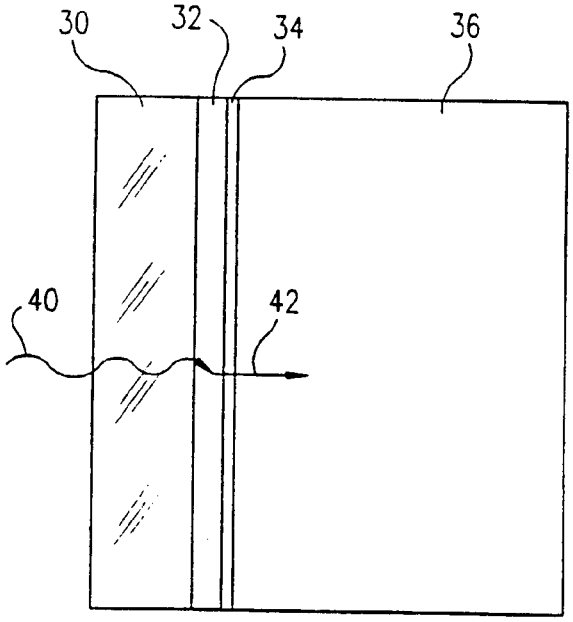
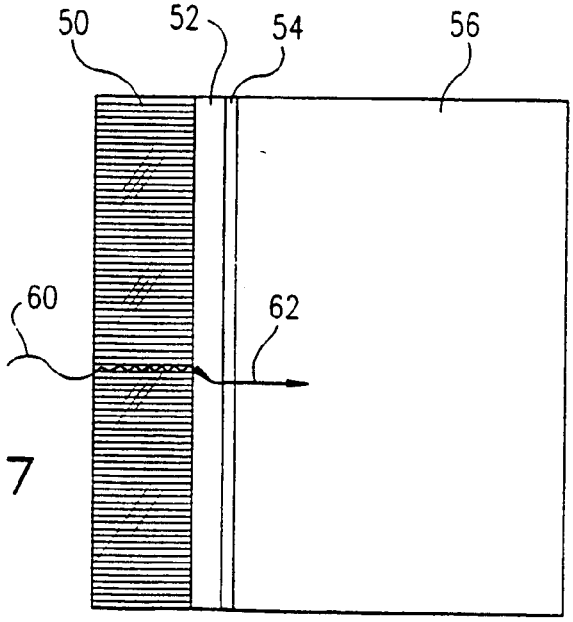
FIG. 7

PROTECTION OF PHOTOCATHODES WITH THIN FILM OF CESIUM BROMIDE

FIELD OF THE INVENTION

The present invention relates to thin-film protection of visible light photocathodes and more particularly to photocathodes protected by thin films and photon sensors and fast electron sources incorporating such photocathodes.

BACKGROUND OF THE INVENTION

It is well known that photosensitive materials operative in the visible range are highly reactive with oxygen, moisture and other impurities. It has been proposed to extend the lifetimes of such materials in a low vacuum or gas environment by coating them with thin solid protective films. The task is not simple since on the one hand the film must be as thin as possible so as to transmit photoelectrons from the photocathode, and on the other hand, sufficiently thick to prevent diffusion of undesired molecules from the gas to the photocathode.

Reference is made iii this context to the following publications, the disclosures of which are hereby incorporated by reference:

R. Enomoto, T. Sumiyoshi and Y. Fujita, Nucl. Instrum. and Meth. A343, 117 (1994);

V. Peskov, A. Borovik-Ramanov, T. Sokolova, E. Silin, Nucl. Instrum. and Meth. A353, 184 (1994);

A. Breskin, A. Buzulutzkov and R. Chechik, IEEE Trans. Nucl. Sci. 43, 298 (1995);

A. Buzulutskov, A. Breskin, R. Chechik, J. Va'vra, Nuclear Instruments and Methods in Physics Research A 371 (1996) 147–150;

A. Breskin, A. Buzulutskov, R. Chechik, M. Prager and E. Shefer, Appl. Phys. Lett. 69, 1008 (1996);

A. Buzulutskov, A. Breskin and R. Chechik, J. Appl. Phys. 81,466 (1997).

Protected photocathodes can find applications in photon sensors such as photon detectors, image intensifiers, TV camera tubes and the like. They can also be applied in accelerators, e.g. in intense electron sources inside radio frequency (RFD) guns. In the latter application, photocathodes operative in vacuum emit electron flushes when irradiated with intense fast laser beams. Protected photocathodes simplify installation and operation and increase the lifetime of the devices.

SUMMARY OF THE INVENTION

The present invention seeks to provide methods for protecting visible light photocathodes with thin protective films as well as photocathodes protected by thin films and photon sensors and fast electron sources incorporating such photocathodes.

There is thus provided in accordance with the invention a thin film-coated photocathode, including a photocathode formed of a first material consisting of potassium cesium antimonide and a thin film coating of a second material consisting of cesium bromide (CsBr).

The materials potassium cesium antimonide and CsBr used in the present invention have lattice constants which are matched.

For the purposes of this patent application "matched" or "matching" means that the atoms of the first and second materials have a spatial relationship therebetween which is periodic. Thus lattice constants that are, for example, identical, or differ by a factor of 2 or the square root of 2 are considered to be matched.

The coated photocathode according to the invention may be transmissive or reflective. Reflective photocathodes may be formed on any clean polished surface. Transmissive photocathodes may be formed on an optically transparent surface, e.g. glass, or on an optical fiber face plate, on a scintillating crystal or on a scintillating fiber face plate.

Additionally in accordance with a preferred embodiment of the present invention there is provided a photon sensor including an electron multiplier and an associated photocathode formed of a first material consisting of potassium cesium antimonide and a coating of a second material consisting of CsBr.

The photon sensor according to the invention may be any photon sensor known in the art such as photon detector, e.g. imaging photon detector, image intensifier and TV camera tube.

The electron multiplier in the photosensor may be any suitable electron multiplier such as a vacuum or gaseous electron multiplier, a wire chamber, an avalanche chamber, a microstrip, microgap, microdot or other micropattem chamber, a Micromegas chamber and a microhole chamber (GEM).

There is also provided according to the invention a fast electron source including a fast photon flux pulse source, an electron accelerator and an associated photocathode formed of a first material consisting of potassium cesium antimonide and a coating of a second material consisting of CsBr. The coated photocathode is preferably thus arranged that it receives as input a fast photon flux pulse from said photon flux pulse source and emits in response a fast pulse of electrons, which are then accelerated by said electron accelerator to provide a fast pulse of energetic electrons.

There is also provided in accordance with a preferred embodiment of the invention a method of providing a photon sensor, more particularly a photon detector, including providing an electron multiplier and providing a photocathode associated with said electron multiplier wherein said photocathode is formed of a first material consisting of potassium cesium antimonide and a coating of thin film of a second material consisting of CsBr.

BRIEF DESCRIPTION OF THE DRAWINGS

The present invention will be more fully appreciated from the following detailed description, taken in conjunction with the drawings in which:

FIG. 5 is an illustration of a reflective photon sensor constructed and operative in accordance with a preferred embodiment of the present invention;

FIG. 6 is an illustration of a transmissive photon sensor constructed and operative in accordance with a preferred embodiment of the present invention; and FIG. 7 is an illustration of a transmissive photon sensor constructed and operative in accordance with another preferred embodiment of the present invention.

DETAILED DESCRIPTION OF PREFERRED EMBODIMENTS

Figure 1:
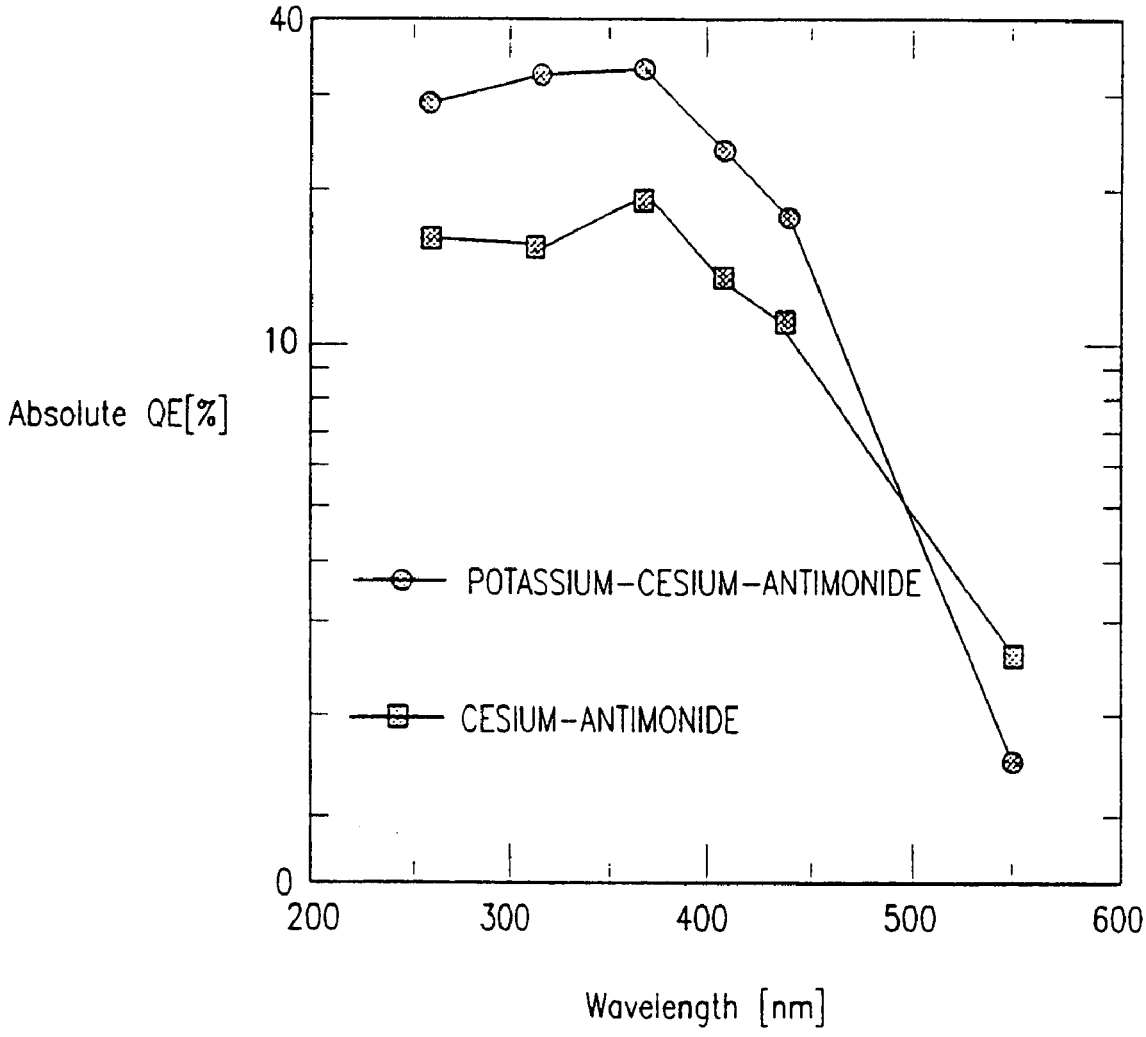
FIG. 1 is a simplified graphical illustration of typical absolute quantum (QE) efficiency spectra of uncoated reflective potassium cesium antimonide photocathode in comparison with cesium antimonide photocathode, as a function of wavelength.

Reference is now made to FIG. 1, which is a simplified graphical illustration of typical absolute quantum efficiency (QE) spectra of uncoated reflective potassium cesium antimonide and cesium antimonide photocathodes. With potassium cesium antimonide photocathodes QE values of 30–35% at the maximum are routinely achieved.

Figure 2:
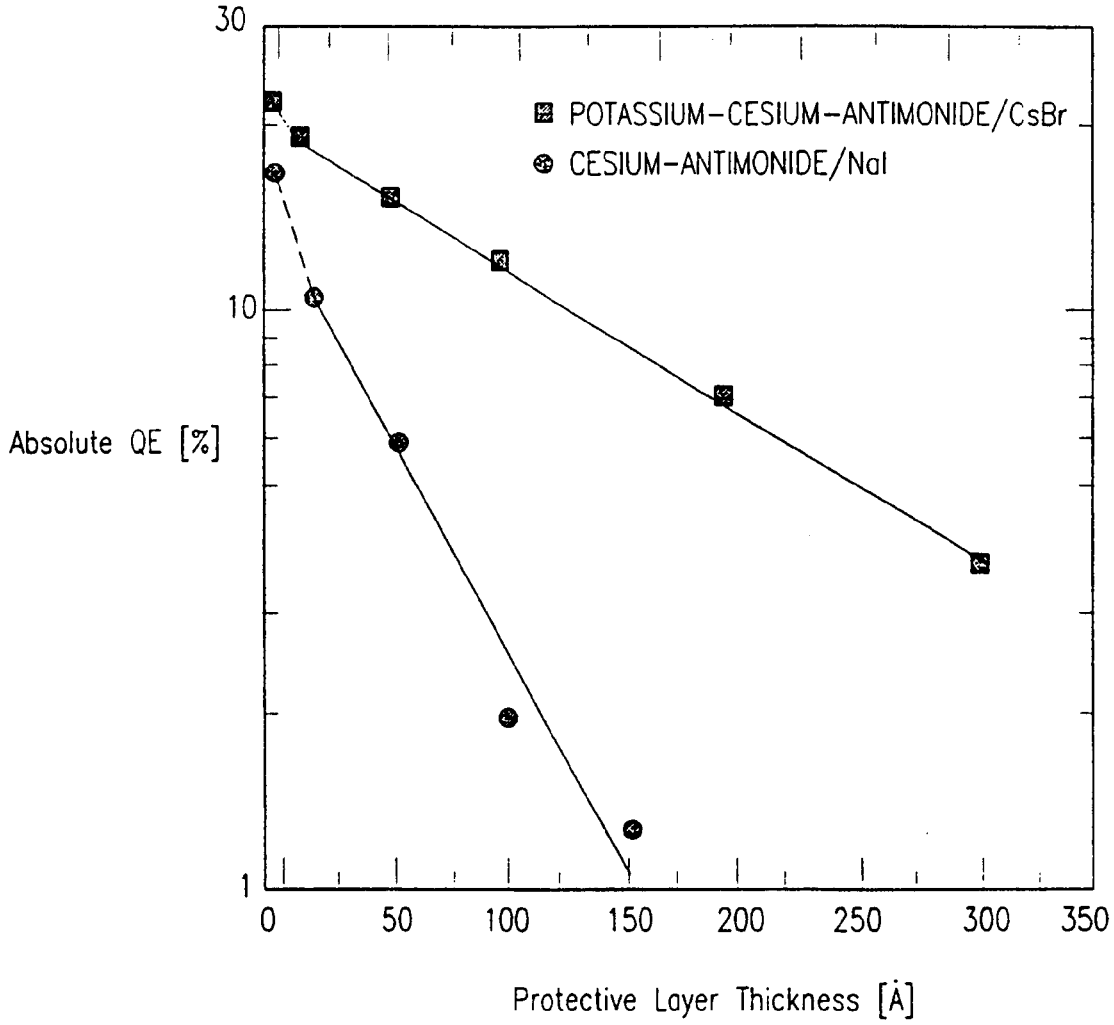
FIG. 2 is a simplified graphical illustration of typical absolute quantum efficiency of the reflective potassium cesium antimonide photocathode of the invention coated with CsBr in comparison with the cesium antimonide photocathode coated with NaI known in the art, as a function of the coating film thickness.

Reference is now made to FIG. 2, which is a simplified graphical illustration of quantum efficiency of the reflective CsBr-coated potassium cesium antimonide photocathode, constructed and operative in accordance with a preferred embodiment of the present invention, in comparison with the known NaI-coated cesium antimonide photocathode, as a function of the coating film thickness; these data were measured at a wavelength of 312 nm. Protective film coating results in an attenuation of the photoyield, with CsBr on potassium cesium antimonide minimizing the attenuation of the quantum efficiency. As shown in FIG. 2, the quantum efficiency decreased by a factor of 6 of its initial value at a wavelength of 312 nm after evaporation of 300 Å of CsBr. For comparison, a 150 Å thick NaI film on cesium antimonide resulted in a decrease of the photoyield by a factor of 15. This may originate from a longer electron escape length through the protective CsBr film, or from a smaller potential barrier in the interface between potassium cesium antimonide and cesium bromide films.

Figure 3:
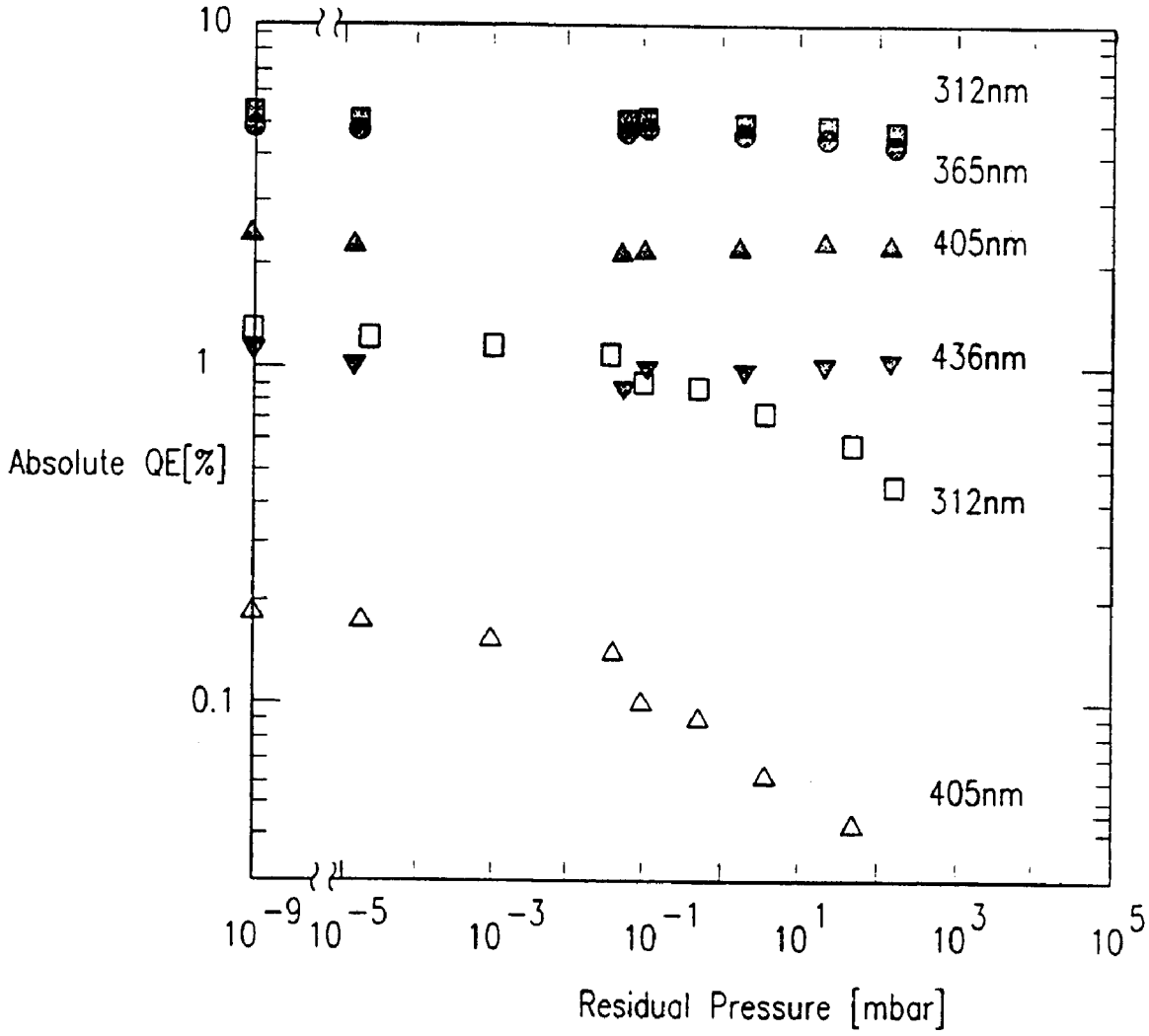
FIG. 3 is a simplified graphical illustration of the absolute quantum efficiency of the reflective potassium cesium antimonide photocathode of the present invention protected with a CsBr film and under exposure to oxygen, at different wavelengths indicated in the figure (full symbols), in comparison with the cesium antimonide photocathode coated with sodium iodide known in the art (hollow symbols), as a function of the residual oxygen pressure.

Reference is now made to FIG. 3, which is a simplified graphical illustration of the absolute quantum efficiency of the reflective potassium cesium antimonide photocathode protected with a CsBr film and under exposure to oxygen, constructed and operative in accordance with a preferred embodiment of the present invention. In FIG. 3, the potassium cesium antimonide photocathode is coated with a 280 Å thick CsBr film, and the exposure time at each data point is 5 min (full symbols). The quantum efficiency is remarkably stable, even at an oxygen pressure of 197 mbar, corresponding to its partial pressure in 1 bar of air, reaching values of 5% at 312 nm. For comparison, the data of a NaI-protected cesium antimonide photocathode are also shown (hollow symbols).

The CsBr protection of potassium cesium antimonide photocathodes from oxygen was observed for coating film thickness of 280 Å and 300 Å, 200 Å thick CsBr films failed to protect the photocathode. A 150 Å thick NaI coating, while successfully protecting cesium antimonide photocathodes, did not provide an efficient protection on potassium cesium antimonide photocathodes. This could be related to lattice mismatching between NaI and potassium cesium antimonide.

Figure 4:
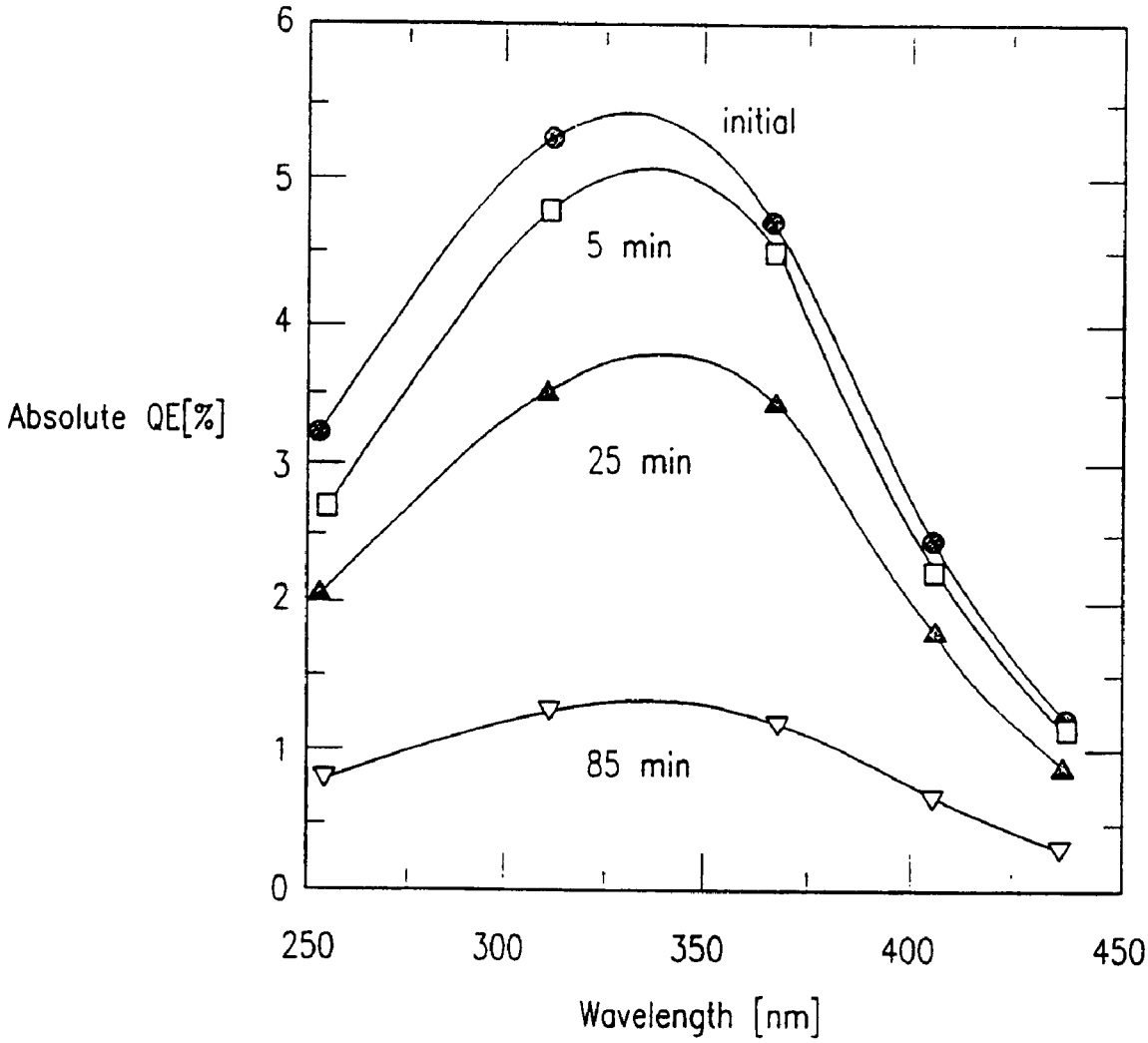
FIG. 4 is a simplified graphical illustration of the absolute quantum efficiency of a reflective potassium cesium antimonide photocathode of the present invention, protected with a CsBr film and under exposure to 197 mbar oxygen, as a function of the wavelength and exposure time, constructed and operative in accordance with another preferred embodiment of the present invention.

Reference is now made to FIG. 4, which is a simplified graphical illustration of the absolute quantum efficiency of the reflective potassium cesium antimonide photocathode protected with a CsBr film and under exposure to oxygen, constructed and operative in accordance with another preferred embodiment of the present invention. FIG. 4 shows the evolution of the quantum efficiency of the CsBr-coated potassium cesium antimonide photocathode, exposed to 197 mbar of oxygen, at different integral exposure times: 5, 25 and 85 minutes. The quantum efficiency at 312 nm drops by about 30% after 25 minutes of exposure to oxygen; after exposure for 1.5 hours the QE is still at the 1% level.

While the details of the protection mechanism are not yet fully understood, it is assumed that the protection against oxygen is caused by an oxidation of the alkali halide films during the exposure procedure. Indeed, it is known that very thin (20–40 Å) surface layers of native oxides, for example $SiO_2$ on Si and $Al_2O_3$ on Al, created by an oxidation in air, provide an effective protection of the bulk against further oxidation. It is also known that stable oxides such as $NaIO_3$, $CsIO_3$ and $CsBrO_3$ do exist, while alkali fluorides and organic films, which for example failed to protect cesium antimonide photocathodes against oxygen, are difficult to oxidize.

The combination of potassium cesium antimonide visible light photocathodes and CsBr coating films is believed to possess superior protective and emissive properties as compared to all previously investigated materials. In particular, CsBr-coated potassium cesium antimonide photocathodes have 5% absolute quantum efficiency at 300–350 nm wavelength range and can withstand the exposure to 197 mbar of oxygen for half an hour with a reasonably small loss of efficiency. These results are better by about an order of magnitude than those obtained for sodium iodide-coated cesium antimonide photocathodes. It is also noted that different photocathode materials require different protective films for best individual results.

The absolute quantum efficiency of CsBr-coated potassium cesium antimonide photocathodes and their stability in oxygen are already sufficiently high to permit their application to scintillation and Cherenkov light detection using gaseous large-area photon imaging detectors. In these detectors, the impurity levels in common gases are at the ppm level. The potential fields of application of this technique are very broad: scintillation calorimetry and Ring Imaging Cherenkov detectors in high energy physics, very large area Cherenkov detectors of solar and cosmic neutrinos in astroparticle physics, Gamma cameras and Positron Emission Tomography (PET) devices in nuclear medicine, etc. Moreover, the level of protection reached is sufficient for handling the photocathodes in dry inert atmosphere for a few hours.

Protected photocathodes are also beneficial inside vacuum-operated devices such as photon sensors incorporating vacuum electron multipliers, or electron sources incorporating electron accelerators. They allow operation under relatively poor vacuum conditions, simplifying the choice of construction materials and processes.

Reference is now made to FIG. 5, which illustrates a reflective photon sensor constructed and operative in accordance with a preferred embodiment of the present invention. The photon sensor comprises a backing 10, preferably formed of glass which is sealingly covering a photocathode 12, over the opposite surface of which is provided a protective thin film coating 14 in accordance with a preferred embodiment of the invention. Adjacent coating 14, there is preferably provided an electron multiplier 16. The electron multiplier 16 may be any suitable electron multiplier, such as a vacuum or gaseous electron multiplier, a wire chamber, an avalanche chamber, a microstrip, microgap, microdot or other micropattern chamber, a Micromegas chamber or a microhole chamber (GEM).

As seen in FIG. 5, a photon 20 enters via an optical window 21 and via the electron multiplier 16 and passes through coating 14 so as to impinge on the photocathode 12, thereby causing electron emission. The electron 22 passes back through the coating 14 into electron multiplier 16, which produces multiple electrons, thereby to provide a detectable signal.

Reference is now made to FIG. 6, which illustrates a transmissive photon sensor constructed and operative in accordance with a preferred embodiment of the present invention. Here, the photon sensor preferably comprises a window 30, preferably formed of glass which sealingly covers a photocathode 32, over the opposite surface of which is provided a protective thin film coating 34 in accordance with a preferred embodiment of the invention. Adjacent coating 34, there is preferably provided an electron multiplier 36. The electron multiplier 36 may be any suitable electron multiplier, such as a vacuum or gaseous electron multiplier, a wire chamber, an avalanche chamber, a microstrip, microgap, microdot or other micropattern chamber, a Micromegas chamber or a microhole chamber (GEM).

As seen in FIG. 6, a photon 40 enters via the window 30 and impinges on the photocathode 32, thereby causing electron emission. An electron 42 passes through the coating 34 to the electron multiplier 36, thereby to provide a detectable signal.

FIG. 6 also schematically illustrates a fast electron source, constructed and operative according to a further preferred embodiment of the present invention. The electron source includes a fast photon flux pulse source 40, whose flux of fast photons is directed to impinge on a photocathode formed of a first material 32 consisting of potassium cesium antimonide and a thin film coating 34 of a second material consisting of CsBr. For this embodiment, the electron multiplier 36 is replaced with an electron accelerator which accelerates the fast pulse of electrons 42 emitted from the coated photocathode to provide a fast pulse of energetic electrons. Likewise, the reflection embodiment of FIG. 5 could also be used as a fast electron source, even more efficient than that of the transmission embodiment of FIG. 6, with the electron multiplier 16 replaced by an electron accelerator, but without the optical window 21 which would prevent passage of the electrons.

Reference is now made to FIG. 7, which illustrates a transmissive photon sensor constructed and operative in accordance with a preferred embodiment of the present invention. Here, the photon sensor preferably comprises a optical fiber face plate 50, which sealingly covers a photocathode 52, over the opposite surface of which is provided a protective thin film coating 54 in accordance with a preferred embodiment of the invention. Adjacent coating 54, there is preferably provided an electron multiplier 56. The electron multiplier may be any suitable electron multiplier, such as a vacuum or gaseous electron multiplier, a wire chamber, an avalanche chamber, a microstrip, microgap, microdot or other micropattern chamber, a Micromegas chamber or a microhole chamber (GEM).

As seen in FIG. 7, a photon 60 enters via the face plate 50 and impinges on the photocathode 52, thereby causing electron emission. An electron 62 passes through the coating 54 to the electron multiplier 56, thereby to provide a detectable signal It is appreciated that instead of face plate 50 or window 30, there may be provided alternatively other photon sources, such as a scintillator or a scintillating fiber array.

It is noted that in the reflective photon sensor shown in FIG. 5, the photocathode 12 may be of any suitable desired thickness. In the transmissive photon sensor shown in FIGS. 6 and 7, the photocathode 32 should be optimized so as to provide a maximum quantum efficiency.

The CsBr-coated potassium cesium antimonide photocathodes of the invention are preferably prepared in vacuum of $10^{-9}$ mbar in the following way: First, a thin antimony layer, with a thickness corresponding to the attenuation of white light transmission down to 70%, is deposited on an optically polished quartz substrate, having electrical contacts on its circumference. The antimony layer is activated first with potassium vapor at 190–230° C. and further with cesium vapor at 140–180° C. After cooling and stabilization, the absolute photocathode quantum efficiency (QE) is measured in reflective mode against a calibrated photodiode, with an accuracy of 10%. This is followed by coating the photocathode with a protective film of CsBr, keeping the photocathode at 50–80° C. during evaporation, and then subjecting to a post-evaporation heating up to 140° C., for a few tens of minutes, followed by cooling.

It is noted that the coated photocathode described hereinabove was exposed to a large amount of impurities. In a vacuum or gaseous device, or in a gloved box connected directly to the photocathode preparation setup, the level of impurities may be reduced by orders of magnitude. This permits much easier manipulation of the photocathode while assembling and operating the photon detector. At low levels of impurities, thinner protection films could in principle be used, resulting in smaller attenuation of the quantum efficiency.

It will be appreciated by persons skilled in the art that the present invention is not limited by what has been particularly shown and described hereinabove. Rather the scope of the present invention is defined only by the claims which follow.

We claim:

1. A thin-film-coated photocathode, comprising a photocathode formed of a first material consisting of potassium cesium antimonide and a thin-film coating of a second material consisting of cesium bromide (CsBr).

2. A CsBr-coated potassium cesium antimonide photocathode according to claim 1, wherein said photocathode is transmissive.

3. A CsBr-coated potassium cesium antimonide photocathode according to claim 2, wherein said transmissive photocathode is formed onto a substrate selected from an optically transparent surface, an optical fiber face plate, a scintillating crystal or a scintillating fiber face plate.

4. A CsBr-coated potassium cesium antimonide photocathode according to claim 1, wherein said photocathode is reflective.

5. A photon sensor including a CsBr-coated potassium cesium antimonide photocathode according to any one of claims 1–4, wherein said coated photocathode is coupled to an electron multiplier.

6. A photon sensor according to claim 5, wherein said electron multiplier is a vacuum electron multiplier.

7. A photon sensor according to claim 5, wherein said electron multiplier is a gas electron multiplier.

8. A photon sensor according to any one of claims 5–7 which is a photon detector, an image intensifier or a TV camera tube.

9. A fast electron source including a fast photon flux pulse source, an electron accelerator and an associated photocathode, wherein said photocathode is formed of a first material consisting of potassium cesium antimonide and a coating of a thin film of a second material consisting of CsBr.

10. A CsBr-coated potassium cesium antimonide photocathode according to claim 1, wherein said CsBr coating is a protective coating.

11. A CsBr-coated potassium cesium antimonide photocathode according to claim 1, wherein said photocathode is a visible light photocathode.

12. A CsBr-coated potassium cesium antimonide photocathode according to claim 1, wherein said photocathode is an ultra-violet light photocathode.

13. A method for providing a thin-film-coated photocathode according to any one of claims 1–4, comprising:

providing a photocathode formed of a first material consisting of potassium cesium antimonide; and coating said photocathode with a thin film of a second material consisting of CsBr.

14. A method of providing a photon sensor according to any one of claims 5 to 8, including:

providing an electron multiplier;

providing a photocathode, associated with said electron multiplier and formed of a first material consisting of potassium cesium antimonide; and coating said photocathode with a thin film of a second material consisting of CsBr.

* * * * *

UNITED STATES PATENT AND TRADEMARK OFFICE

CERTIFICATE OF CORRECTION

PATENT NO. : 6,531,816 B1
DATED : March 11, 2003
INVENTOR(S) : Amos Breskin et al.

It is certified that error appears in the above-identified patent and that said Letters Patent is hereby corrected as shown below:

Title page,
Item [57], ABSTRACT,
Line 1, delete "This invention discloses a" and replace with -- A --.
Line 2, after "formed of" insert -- a --
Line 3, replace "cesiuin" with -- cesium --

Column 7,
Line 3, replace "any one of claims 5-7" with -- claim 5 --

Column 8,
Line 10, replace "claims 5 to 8" with -- claim 5 --

Signed and Sealed this

Sixteenth Day of November, 2004

JON W. DUDAS
*Director of the United States Patent and Trademark Office*